US010052673B2

(12) United States Patent
Huang et al.

(10) Patent No.: US 10,052,673 B2
(45) Date of Patent: Aug. 21, 2018

(54) FORMING METHOD AND DIE ASSEMBLY USING A BEAD WITH A STEP

(71) Applicant: Ford Motor Company, Dearborn, MI (US)

(72) Inventors: Liang Huang, Troy, MI (US); Evangelos Liasi, Royal Oak, MI (US)

(73) Assignee: Ford Motor Company, Dearborn, MI (US)

( * ) Notice: Subject to any disclaimer, the term of this patent is extended or adjusted under 35 U.S.C. 154(b) by 0 days.

(21) Appl. No.: 15/135,661

(22) Filed: Apr. 22, 2016

(65) Prior Publication Data

US 2017/0304886 A1 Oct. 26, 2017

(51) Int. Cl.
*B21D 24/04* (2006.01)
*B21D 22/22* (2006.01)

(52) U.S. Cl.
CPC ..... *B21D 24/04* (2013.01); *B21D 22/22* (2013.01)

(58) Field of Classification Search
CPC ..... B21D 22/22; B21D 24/04; B21D 24/16; B21D 22/00; B21D 22/02; B21D 22/16; B21D 22/24
See application file for complete search history.

(56) References Cited

U.S. PATENT DOCUMENTS 1,915,102 A * 6/1933 Rehbein ..... B21D 22/02 296/210
6,196,043 B1 * 3/2001 Ehardt ..... B21D 22/22 72/350
8,831,914 B2 9/2014 Shen et al.
9,120,137 B2 9/2015 Zhou et al.
9,782,815 B2 * 10/2017 Sallade ..... B21D 22/20
2015/0343514 A1 * 12/2015 Inoue ..... B21D 22/26 72/348

FOREIGN PATENT DOCUMENTS

| | | | | |
|---|---|---|---|---|
| CN | 202263837 | | 6/2012 | |
| CN | 103341556 | | 10/2013 | |
| CN | 103418659 | | 12/2013 | |
| CN | 103418658 | | 3/2015 | |
| DE | 102012014201 | B3 * | 8/2013 | ..... B21D 22/22 |
| JP | 2004154786 | | 6/2004 | |
| JP | 2004154786 | A * | 6/2004 | |
| JP | 2004160490 | | 6/2004 | |

OTHER PUBLICATIONS

Translation of JP 2004154786A, Sakurai et al., translated on Nov. 27, 2016, 8 pages.*

* cited by examiner

*Primary Examiner* — Teresa M Ekiert
(74) *Attorney, Agent, or Firm* — Carlson, Gaskey & Olds, P.C.

(57) ABSTRACT

An exemplary die assembly includes, among other things, a first die having a male bead, a second die having a female bead configured to receive the male bead to hold a workpiece between the first die and the second die, and a step in the male bead, the female bead, or both. An exemplary forming method includes, among other things, holding a workpiece between a male bead of a first die and a female bead of a second die, wherein the male bead, the female bead, or both have at least one step.

21 Claims, 4 Drawing Sheets

FORMING METHOD AND DIE ASSEMBLY USING A BEAD WITH A STEP

TECHNICAL FIELD

This disclosure relates generally to forming a workpiece and, more particularly, to a stepped bead that resists flow of the workpiece during the forming.

BACKGROUND

Beads can control material flow as a punch forms a workpiece, such as a blank of material. A typical bead includes a male portion on a first die, and a female portion on a second die.

During forming, the bead holds some areas of the workpiece between the male and female portions. After the punch forms a desired shape in the workpiece, extra material is removed from the desired shape. The extra material can include the areas held between the male and female portions of the bead after forming the desired shape.

The bead can provide a varied amount of resistance to material flow based on, among other things, the material composition of the workpiece and whether lubricants are used during the forming. That is, a bead that can substantially prevent flow of a steel workpiece during forming may be unable to prevent flow of an aluminum workpiece, especially if the aluminum workpiece is lubricated. Example beads include draw beads, which permit some material flow during forming, and lock beads, which substantially prevent material flow.

If a single bead does not provide a desired resistance to material flow, some material forming processes include more than one bead between an outer edge of the material and an area of the material contacting the punch. Holding the material with more than one bead during forming increases resistance to material flow, but can also increase a size of the workpiece required to form the desired shape. If the size of the workpiece increases, there is more extra material after forming the desired shape.

SUMMARY

A die assembly according to an exemplary embodiment of the present disclosure includes, among other things, a first die having a male bead, a second die having a female bead configured to receive the male bead to hold a workpiece between the first die and the second die, and a step in the male bead, the female bead, or both.

In another example having one or more features of the foregoing assembly, a first side and the second side of the male bead extend from a primary workpiece holding surface of the first die to a leading surface of the male bead. The step is provided in the first side, the second side, or both.

In another example having one or more features of the foregoing assemblies, the step is spaced from the primary workpiece holding surface and the leading surface.

In another example having one or more features of the foregoing assemblies, the step includes a step surface generally aligned with the primary workpiece holding surface and the leading surface.

In another example having one or more features of the foregoing assemblies, the leading surface is planar.

In another example having one or more features of the foregoing assemblies, a first side and the second side of the female bead extend from a primary workpiece holding surface of the second die to a floor of the female bead. The step is provided in the first side, the second side, or both.

In another example having one or more features of the foregoing assemblies, both a side of the male bead and a side of the female bead include the step.

In another example having one or more features of the foregoing assemblies, opposing sides of the male bead each include a step, and opposing sides of the female bead each include a step.

In another example having one or more features of the foregoing assemblies, a first side of the male bead and a first side of the female bead include the step, and an opposing second side of the male bead and an opposing second side of the female bead exclude any step.

In another example having one or more features of the foregoing assemblies, the male bead and the female bead are configured to hold a sheet of material when forming the sheet of material.

In another example having one or more features of the foregoing assemblies, the male bead and the female bead are configured to hold a sheet of material when forming the sheet of material.

In another example having one or more features of the foregoing assemblies, the male bead and the female bead are portions of a lock bead.

A forming method according to another exemplary aspect of the present disclosure includes, among other things, holding a workpiece between a male bead of a first die and a female bead of a second die, wherein the male bead, the female bead, or both have at least one step.

Another example having one or more features of the foregoing method includes the workpiece comprising aluminum.

Another example having one or more features of any of the foregoing methods includes lubricating the workpiece with a hot melt lubrication.

Another example having one or more features of any of the foregoing methods includes forming the workpiece during the holding.

Another example having one or more features of any of the foregoing methods includes holding the workpiece using a first side and a second side of the male bead. The first and second sides each extend from a primary workpiece holding surface of the first die to a leading surface of the male bead. The step is provided in the first side, the second side, or both.

Another example having one or more features of any of the foregoing methods includes holding the workpiece using a first side and a second side of the female bead. The first and second sides each extend from a primary workpiece holding surface of the second die to a bottommost floor of the female bead. The step provided in the first side, the second side, or both.

Another example having one or more features of any of the foregoing methods includes preventing movement of the material when holding the material during a forming process such that the male bead and female bead provide a lock bead.

Another example having one or more features of any of the foregoing methods includes permitting some movement of the material when holding the material during a forming process such that the male bead and female bead provide a draw bead.

Another example having one or more features of any of the foregoing methods includes each of the at least one steps being provided in a side of the male bead or the female bead.

BRIEF DESCRIPTION OF THE FIGURES

The various features and advantages of the disclosed examples will become apparent to those skilled in the art from the detailed description. The figures that accompany the detailed description can be briefly described as follows.

DETAILED DESCRIPTION

This disclosure relates generally to a forming process and, more particularly, to a bead that holds material during forming. The forming process is a stamping process, for example.

The bead includes a step on at least one side. The step increases a resistance to material flow provided by the bead. In some examples, a single bead with a step can be used to resist material flow. The single bead is positioned between a cavity of a die and an outer edge of a workpiece. The single bead with the step provides a desired resistance so that incorporating other beads between the cavity and the outer edge is not required.

Figure 1:
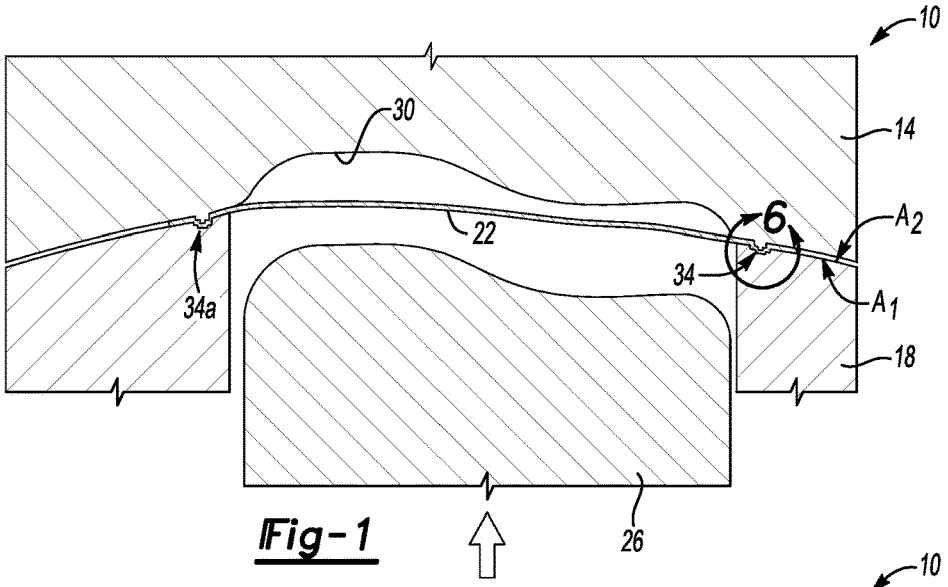
FIG. 1 illustrates an example forming assembly during a forming process prior to a punch forming a desired shape in a workpiece.
Figure 2:
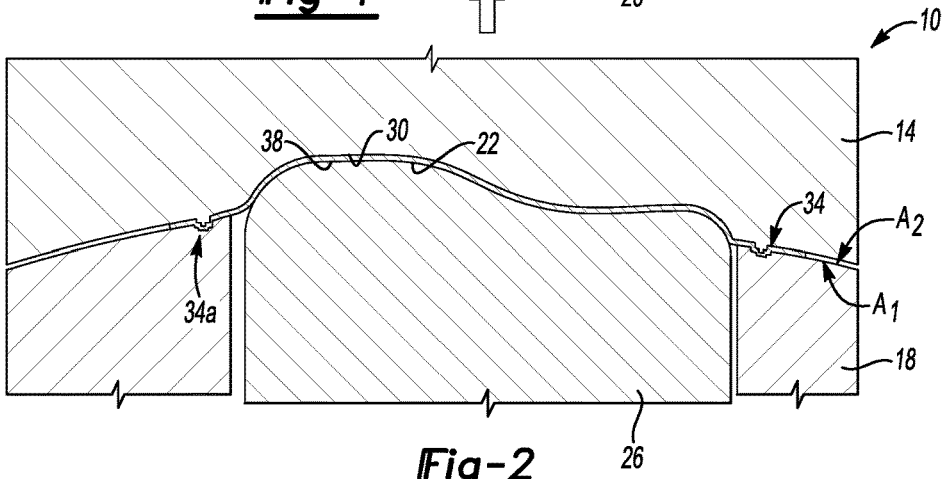
FIG. 2 illustrates the forming assembly of FIG. 1 later in the forming process after the punch forms the desired shape in the workpiece.
Figure 3:
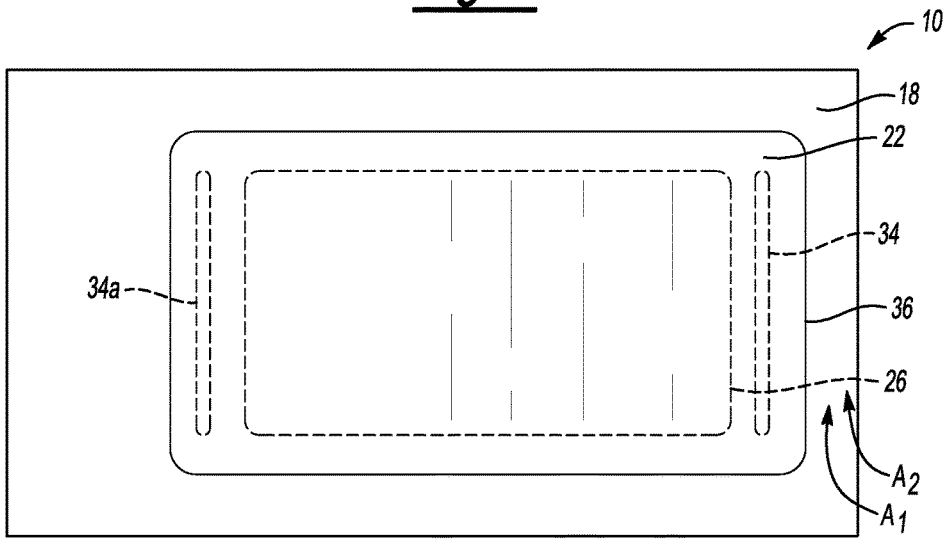
FIG. 3 illustrates a top view of the forming assembly of FIG. 2 with a die containing a cavity removed to show the workpiece.

Referring to FIGS. 1 to 3, a die assembly 10 includes a first die 14 and a second die 18. The die assembly 10 can be used in a forming process to manufacture a workpiece 22 into a part having a desired shape.

The first die 14 is an upper die, and the second die 18 is a lower die, but other configurations are possible. In some examples, the second die 18 is referred to as a binder ring or blank holder.

The workpiece 22 includes areas held between the first die 14 and the second die 18. Other areas of the workpiece 22 extend between a punch 26 and a cavity 30. The first die 14 provides the cavity 30 in this example, although other configurations, such as a cavity in the second die 18, are possible. The example workpiece 22 is a blank of material. The workpiece 22 can be a flat sheet of material or include some preformed contours.

During forming, the punch 26 moves against the material from the position of FIG. 1 to the position of FIG. 2. In the position of FIG. 2, the punch 26 has pressed an area of the workpiece 22 into the cavity 30 to provide a desired shape 38.

At least one bead 34 controls a flow of the workpiece 22 toward the punch 26 and the cavity 30 during forming. The bead 34 creates tension in the workpiece 22 during forming. The tension, among other things, prevents excessive drawing during forming. The tension can stretch the material of the workpiece 22 and can improve a quality of the forming by enhancing dent resistance and appearance, and by providing dimensional stability. To create tension, the bead 34 forces the material moving through the bead 34 to bend and unbend, which resists movement of the material toward the punch 26 and the cavity 30. Using the bead 34 can provide, in some examples, ten times more resistance to material movement than if the bead 34 is not used.

In some examples, the bead 34 is a lock bead or square bead that substantially prevents a flow of material during forming. When the bead 34 is a lock bead, moving the punch 26 against the workpiece 22 does not draw material at an outer periphery of the workpiece 22 through the bead 34. In other examples, the bead 34 is a draw bead or flow bead that permits some flow of material during forming. When the bead 34 is a draw bead, moving the punch 26 against the workpiece 22 draws material at an outer periphery of the workpiece 22 through the bead 34.

In this example, two separate beads 34 and 34*a* are used when forming the desired shape 38. The bead 34 extends along a first side of the punch 26 and cavity 30. The bead 34*a* extends along an opposing, second side of the punch 26 and cavity 30. The bead 34 provides a desired resistance to material flow on the first side, and the bead 34*a* provides a desired resistance to material flow on the second side. The bead 34 on the first side can provide a different resistance to material flow than the bead 34*a* on the second side. For example, the bead 34 can be a lock bead, and the bead 34*a* can be a draw bead.

Because a desired resistance to material flow on the first side is achieved with the bead 34, additional beads between the punch 26 and an outer edge 36 of the workpiece 22 (or between the cavity 30 and the outer edge 36) are not required.

In the prior art, additional beads were included at areas $A_1$, area $A_2$, or both to increase resistance on the first side. To engage these additional beads, the size of the workpiece would be increased relative to the workpiece 22. The increased size of the workpiece permitted the workpiece to extend between the areas including the additional beads.

If the bead 34 is unable to provide a desired resistance, one or more additional beads can be included in areas at areas $A_1$, area $A_2$, or both to increase the resistance to material flow. Since the bead 34 provides greater resistance to material flow, the total number of beads 34 between the punch 26 and the outer edge 36 of the workpiece 22 still less than the number of prior art beads that would be required to provide the desired resistance.

Figure 4:
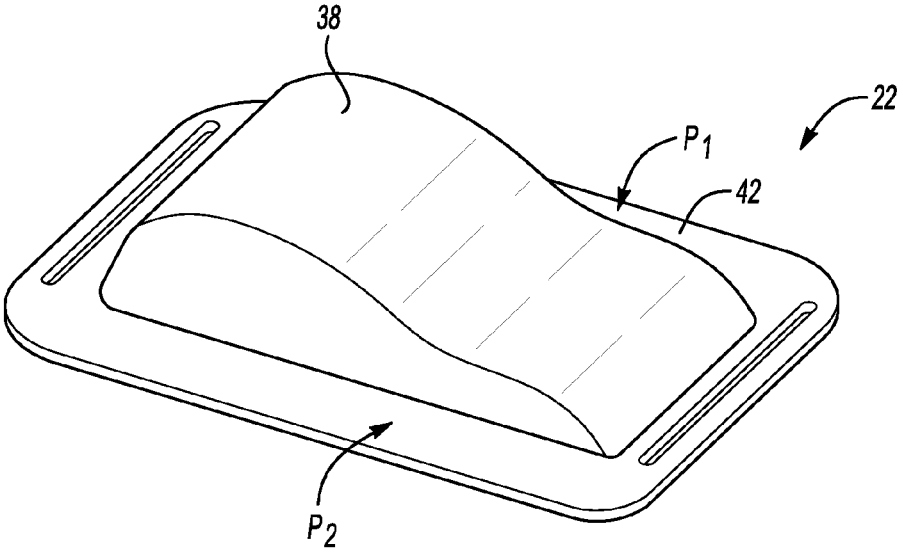
FIG. 4 illustrates the desired shape formed using the forming assembly of FIGS. 1 and 2.

Referring now to FIG. 4, with continued reference to FIG. 2, the workpiece 22 has been formed to have the desired shape 38. Extra material 42 is connected to the desired shape 38. The extra material 42 is not part of the desired shape 38. The extra material 42 can include material that remained between the first die 14 and the second die 18 after the punch 26 formed the desired shape 38 in the workpiece 22. The extra material 42 can include areas of the material that remained within the beads 34 after forming.

Other beads could be used to hold other areas of the outer periphery of the workpiece 22 to provide a desired resistance to material flow during forming. For example, other beads could be used to resist material flow in areas Pi and P2 of the workpiece 22.

Figure 5:
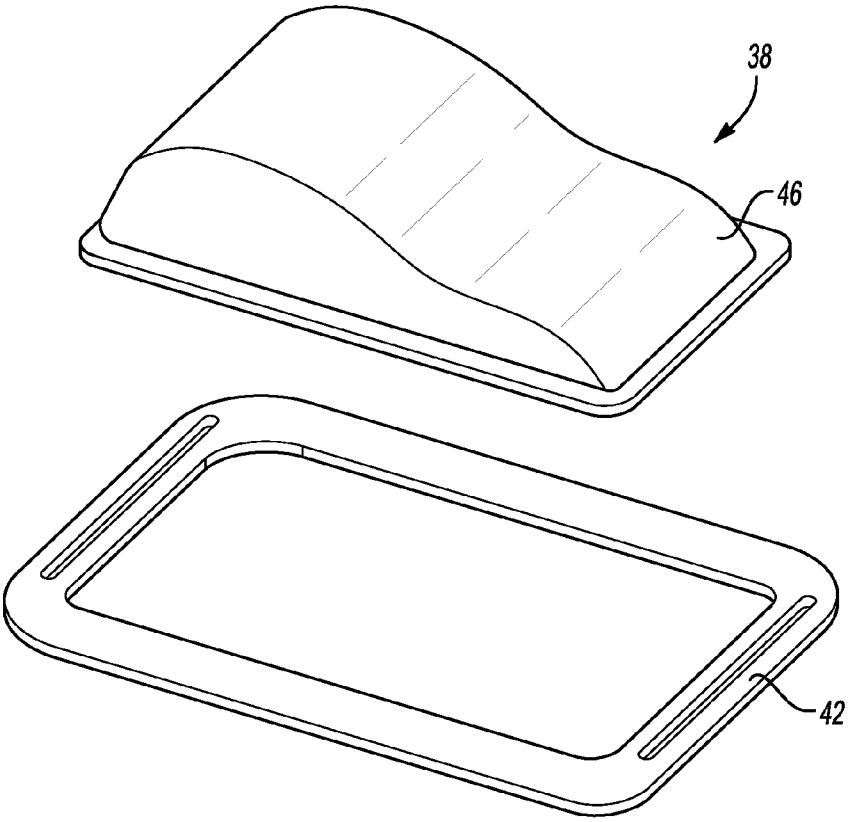
FIG. 5 illustrates unwanted material separated from the desired shape of FIG. 4 to provide a part.

In FIG. 5, the extra material 42 is separated from the desired shape 38 to provide a formed part 46. A trimming operation, for example, can be used to separate the extra material 42 from the desired shape 38. If additional beads were used on the first side or the second side, the amount of extra material 42 could increase.

In some examples, the formed part 46 is a panel for a vehicle, such as a door panel or hood. In other examples, the formed part 46 could be used as a hood or as some other component.

Figure 6:
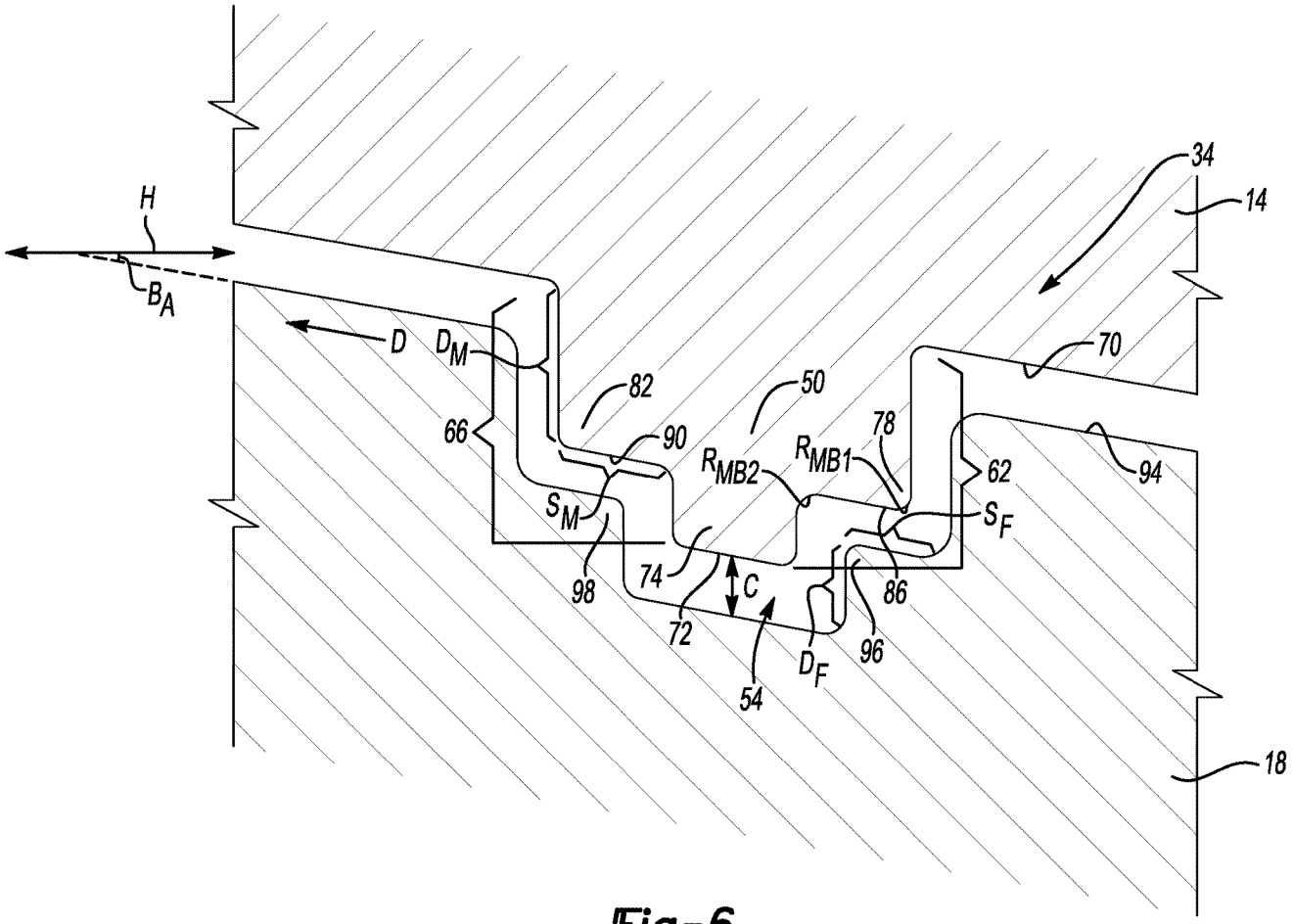
FIG. 6 shows a close-up view of a bead in Area-6 of FIG. 1.

Referring now to FIG. 6, with continued reference to FIG. 1, the example bead 34 is a lock bead having a double step. The bead 34 applies a locking force to the workpiece 22 to prevent movement of material through the bead 34 during forming. In another example, the bead 34 is a draw bead that can restrain a flow of material. A resistance to material flow provided by the bead 34 when the bead 34 is a draw bead can be more than 70 percent of the locking force, in a non-limiting example.

The bead 34 includes a male bead 50 of the first die 14 and a female bead 54 of the second die 18. The female bead 54 is configured to receive the male bead 50 to hold material during forming. The workpiece 22 is not shown in FIG. 6 for drawing clarity.

The male bead 50 includes a first side 62 and an opposing second side 66. The first side 62 and the second side 66 extend from a primary workpiece holding surface 70 of the first die 14 and terminate at a leading surface 72 on a tip 74 of the male bead 50.

The tip 74 has a rectangular cross-sectional profile in this example. In another example, the tip 74 has another profile, such as a circular or ovular profile.

The bead 34 incorporates features that provide substantially increased resistance to material flow when compared to prior art bead designs. Thus, rather than requiring an area of the workpiece 22 to pass or extend through several distinct beads during forming, a desired resistance can be achieved utilizing the bead 34.

In this example, these features include a step 78 on the first side 62, and a step 82 on the second side 66 of the male bead 50. The step 78 includes a step surface 86, and the step 82 includes a step surface 90. The step surface 86 and the step surface 90 are positioned between the tip 74 and the primary workpiece holding surface 70 of the first die 14. In this example, the step surfaces 86 and 90 are generally parallel to the primary workpiece holding surface 70 and the leading surface 72 of the tip 74.

The female bead 54 is recessed from a primary workpiece holding surface 94 of the second die 18. A step 96 in a first side of the female bead 54 corresponds to the step 78 of the male bead 50, and a step 98 in an opposing, second side of the female bead 54 corresponds to the step 82 of the male bead 50. Thus, in this example, a profile of the female bead 54 is generally the same as a profile of the male bead 50, such that the male bead 50 and female bead 54 are dimensional opposites. The first and second sides of the female bead 54 oppose each other and extend from the primary workpiece holding surface 94 to a bottommost floor of the female bead 54.

Both the male bead 50 and the female bead 54 include steps in this example. In another example, the steps are only on the male bead 50 or only on the female bead 54.

When the workpiece 22 is held between the male bead 50 and the female bead 54 during forming, the material must bend and unbend multiple times in order to move in a direction of draw D toward the die cavity 30. In this example, the forces required to overcome the resistance associated with these multiple bendings and unbendings of the material are not reached during the forming operation. The bead 34 thus locks the material in position during forming.

In other examples, the bead 34 can be adjusted to provide a resistance to material flow that permits some flow of material during forming. In such examples, the bead 34 is considered a draw bead.

Notably, the radii on the male bead 50 and on the female bead 54 can be increased or decreased to provide, among other things, a desired resistance to material flow. Increasing the radii can also result in less wear of the first die 14 and the second die 18 due to forming. The first die 14 and the second die 18 are typically cast and comprise, among other things, iron or steel.

Due to the steps 78, 82 of the male bead 50 and the steps 96, 98 of the female bead 54, the bead 34 includes many more radii than prior art beads, which lack any step. The increased number of radii provide a greater design flexibility when adjusting to provide a desired resistance to material flow. For example, both a radius $R_{MB1}$ and a radius $R_{MB2}$ on the first side 62 of the male bead 50, and corresponding radii on the second side 66 can be increased or decreased to adjust a resistance to material flow, to decrease wear on the first die 14, etc. Beads without a step lack the radius $R_{MB1}$ and a radius $R_{MB2}$.

Other features can also be adjusted so that the bead 34 provides a desired resistance. Some such features include a size $S_M$ of one or both of the steps 78, 82 of the male bead 50, or a size $S_F$ in one or both of the steps 96, 98 of the female bead 54. Other such factors include a depth $D_M$ of one or both of the steps 78, 82 of the male bead 50, or a depth $D_F$ in one or both of the steps 96, 98 of the female bead 54. Still other factors include a clearance C between the male bead 50 and the female bead 54. The clearance C is not required to be consistent throughout the bead 34. For example, the clearance C between the leading surface 72 and the female bead 54 could be different than a clearance between the step 78 and the step 96.

Generally, a severity of the bending and unbending of the material is the sum of the forces required to overcome the bending and unbending and each transition or radius of the bead 34. The forces at each transition are dictated by the size of the radius and, to a lesser extent, by a groove angle, which is controlled by a depth and clearance of the transition.

At least because the bead 34 can provide greater resistance to material flow than a bead lacking a step, the first die 14 does not need to include another bead in areas $A_1$ and $A_2$. Thus, as mentioned above, the workpiece 22 does not need to extend from the punch 26 and cavity 30 all the way to areas $A_1$ and $A_2$ during forming.

In this example, a depth of the step 78 is the same as a depth of the step 82, but these depths could vary relative to each other. Further, in this example, a depth of the step 96 is the same as a depth of the step 98, but these depths could be varied relative to each other.

Figure 7:
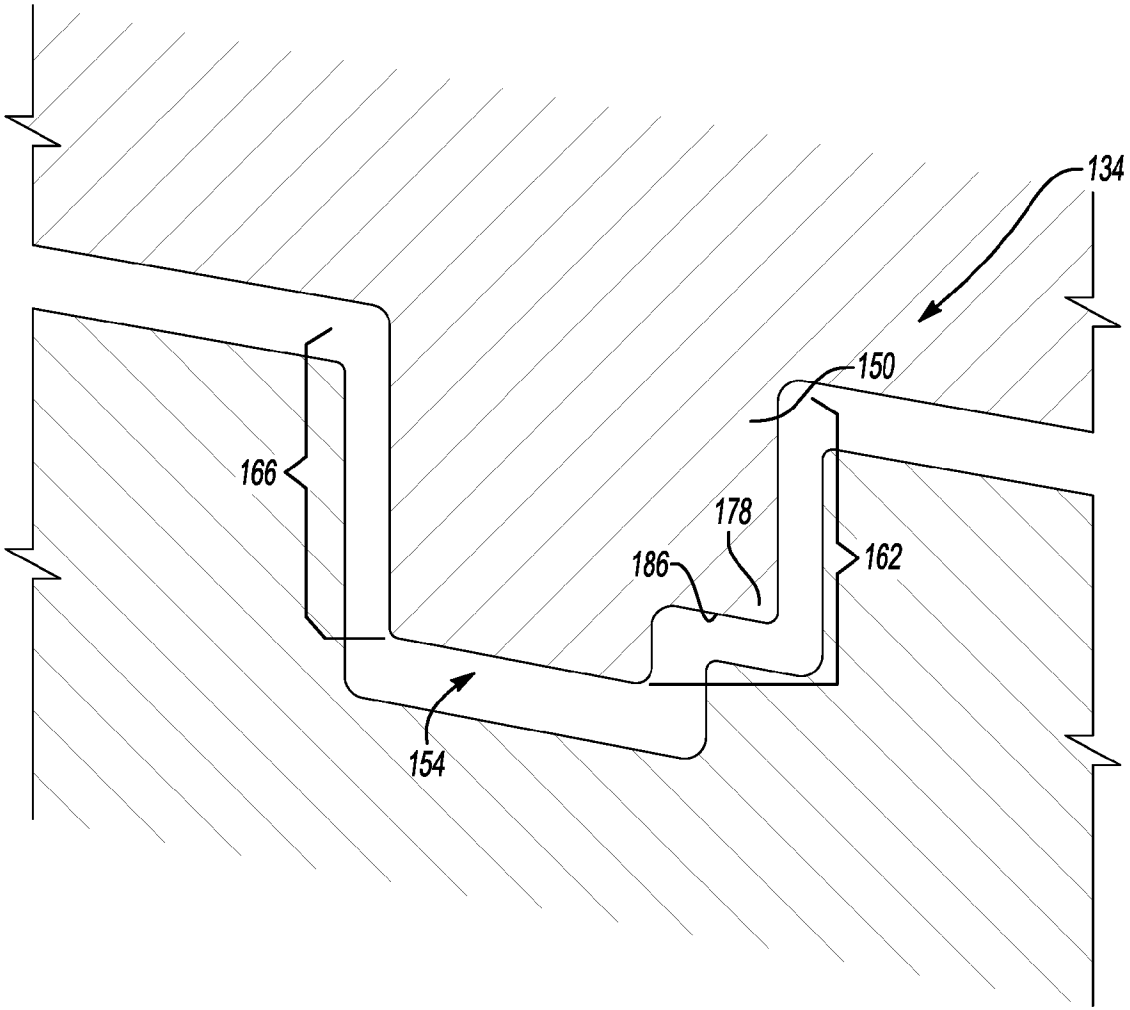
FIG. 7 shows a close-up view of another example bead for a die assembly.

Referring now to FIG. 7, another example bead 134 includes a male bead 150 and a female bead 154. The male bead 150 has a first side 162 and an opposing second side 166. The first side 162 includes a step 178 having a step surface 186. The second side 166 includes no step. In this example, the bead 34 can provide a resistance to material flow that is less than the bead 34 in FIG. 6, but greater than a bead lacking a step.

In another example, the bead 134 could include the step 178 on the second side 166 instead of the first side 162.

Referring again to FIG. 6 with continuing reference to FIG. 7, the bead 34 and the bead 134 are particularly useful to provide increased resistance to hold materials during forming. The bead 34 or the bead 134 can be used instead of beads that lack a step and incorporate relatively sharp geometries. Example materials include, but are not limited to, aluminum materials. If these material are lubricated, the bead 34 or 134 may need to provide even more resistance. The angle that material is drawn into the die cavity 30 can further affect how a bead resists material flow. The beads 34 and 134 are particularly useful in negative binder angle conditions as shown.

Generally, a binder angle BA an angle or inclination of the workpiece holding surface 94 with respect to an axis that is perpendicular to the motion of the punch 26 (FIGS. 1 and 2). The primary workpiece holding surface 94 extends from an outermost edge of the second die 18 to the cavity 30. In the examples of FIGS. 6 and 7, the binder angle $B_A$ is −15 degrees.

Features of the disclosed examples include a bead providing a restraining force to materials, such as a lubricated aluminum material. The bead achieves restraining force objectives without requiring an increase in blank or workpiece size. In some examples, the bead geometries can result in a 10-15 millimeter reduction in an overall blank size required to form a given component.

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

What is claimed is:

1. A die assembly, comprising:

a first die having a first male bead with first and second sides that each extend from a primary workpiece holding surface of the first die to a leading surface of the first male bead;

a second die having a first female bead configured to receive the first male bead to hold a workpiece between the first die and the second die;

a step in the first side, the second side, or both, wherein at least one of the first die or the second die includes a cavity corresponding to a desired shape of the workpiece, wherein the first male and first female bead provide a first bead assembly spaced from a first side of the cavity; and a second bead assembly having a second female bead configured to receive a second male bead, the second bead assembly spaced from an opposite, second side of the cavity.

2. The die assembly of claim 1, wherein the step is spaced from the primary workpiece holding surface and the leading surface of the first male bead.

3. The die assembly of claim 2, wherein the step includes a step surface generally aligned with the primary workpiece holding surface and the leading surface.

4. The die assembly of claim 1, wherein the leading surface is planar.

5. The die assembly of claim 1, comprising a first side and a second side of the first female bead, the first and second sides of the first female bead each extending from a primary workpiece holding surface of the second die to a floor of the first female bead, and further comprising another step provided in the first side of the first female bead, the second side of the first female bead, or both.

6. The die assembly of claim 1, wherein the first side of the first male bead includes the step, and a first side of the first female bead include another step, wherein the second side of the first male bead opposes the first side of the first male bead and lacks any step, wherein a second side of the first female bead opposes the first side of the first female bead and lacks any step.

7. The die assembly of claim 1, wherein the first and second sides of the first male bead are opposing sides of the first male bead and each include a step, wherein opposing sides of the first female bead each include a step.

8. The die assembly of claim 1, wherein the first male bead and the first female bead are portions of a lock bead.

9. A forming method, comprising:

providing a male bead of a first die and a female bead of a second die, the male bead including first and second sides that each extend from a primary workpiece holding surface of the first die to a leading surface of the male bead, the first and second sides each having at least one step;

holding extra material of a workpiece between the male and female beads;

forming a desired shape in the workpiece during the holding, the desired shape and the extra material corresponding to separate and distinct areas of the workpiece; and trimming the desired shape from the extra material to provide a formed part.

10. The method of claim 9, wherein the workpiece comprises aluminum.

11. The method of claim 9, comprising lubricating the workpiece with a hot melt lubrication.

12. The method of claim 9, comprising holding the workpiece using a first side and a second side of the female bead, the first and second sides of the female bead each extending from a primary workpiece holding surface of the second die to a bottommost floor of the female bead, the first and second sides of the female bead having at least one step.

13. The method of claim 9, comprising preventing movement of a portion of the workpiece held between the male bead and the female bead during the forming such that the male bead and female bead provide a lock bead.

14. The method of claim 9, comprising permitting some movement of a portion of the workpiece held between the male bead and the female bead during the forming such that the male bead and female bead provide a draw bead.

15. The method of claim 9, wherein the at least one step is spaced from both the primary workpiece holding surface and the leading surface of the male bead.

16. A forming method, comprising:

moving a first and a second die relative to each other to hold extra material of a workpiece between a male bead of the first die and a female bead of the second die;

forming a desired shape in an area of the workpiece that does not include the extra material;

restricting movement of the workpiece using at least one step in a side of the male bead, the side extending from a primary workpiece holding surface of the first die to a leading surface of the male bead; and trimming the extra material from the desired shape to provide a formed part.

17. The forming method of claim 16, wherein the restricting comprises permitting some movement of the workpiece such that the male and female beads together provide a draw bead.

18. The forming method of claim 16, wherein the restricting comprises preventing movement of the workpiece such that the male and female beads together provide a lock bead.

19. The forming method of claim 16, wherein the side is a first side, and the forming method further comprises restricting movement of the workpiece using at least one step in an opposite, second side of the male bead.

20. The method of claim 16, wherein the at least one step in the side of the male bead is spaced from both the primary workpiece holding surface of the first die and the leading surface of the male bead.

21. A die assembly, comprising:

a first die;

a second die, at least one of the first or the second die including a cavity corresponding to a desired shape of a workpiece;

first and second bead assemblies spaced from opposite sides of the cavity, and each including a male bead on one of the first or the second die that is received within a female bead on the other of the first or the second die to hold the workpiece between the first and second die, each of the male beads having a leading surface, first and second sides that oppose each other and that each extend from a primary workpiece holding surface of the first or second die to the bead leading surface, and a step spaced a distance from both the leading surface and the primary workpiece holding surface, the step in the first side, the second side, or both.

* * * * *